United States Patent [19]

Erickson et al.

[11] 3,935,712

[45] Feb. 3, 1976

[54] CABLE LAYING VIBRATORY PLOW ASSEMBLY

[75] Inventors: Robert W. Erickson; John F. Lindell, both of Newton, Iowa

[73] Assignee: Koehring Company, Milwaukee, Wis.

[22] Filed: Jan. 16, 1975

[21] Appl. No.: 541,527

[52] U.S. Cl. ..... 61/72.6; 172/40

[51] Int. Cl.² ..... A01B 11/00; F16L 1/00

[58] Field of Search ..... 61/72.6, 72.5, 72.7; 39/193; 172/40; 173/49; 299/14; 175/40

[56] References Cited

UNITED STATES PATENTS

| | | | |
|---|---|---|---|
| 3,385,119 | 5/1968 | Berger | 172/40 |
| 3,528,302 | 9/1970 | Kinnan | 173/49 X |
| 3,575,006 | 4/1971 | Rugroden | 61/72.6 |
| 3,863,721 | 2/1975 | Scerbo et al. | 173/49 X |

*Primary Examiner*—Jacob Shapiro
*Attorney, Agent, or Firm*—Andrew J. Beck

[57] ABSTRACT

A plow assembly for cutting a slit in the ground and simultaneously laying a cable in the slit as the propelling vehicle moves over the ground. The plow assembly has a shaker case containing a pair of counter-rotating eccentric weights for providing a vibratory action to the plow, additional weight means are located rearwardly of the plow and plow frame so as to reduce the amplitude of vibration at the rear end of the assembly, and the assembly also has elastomeric isolation mounts for the shaker case on the plow frame so that the resulting action of all the components is such that the plow blade pivots about a pivot point located rearwardly of the assembly and in a particularly efficient arcuate cutting movement.

7 Claims, 12 Drawing Figures

FIG. 9
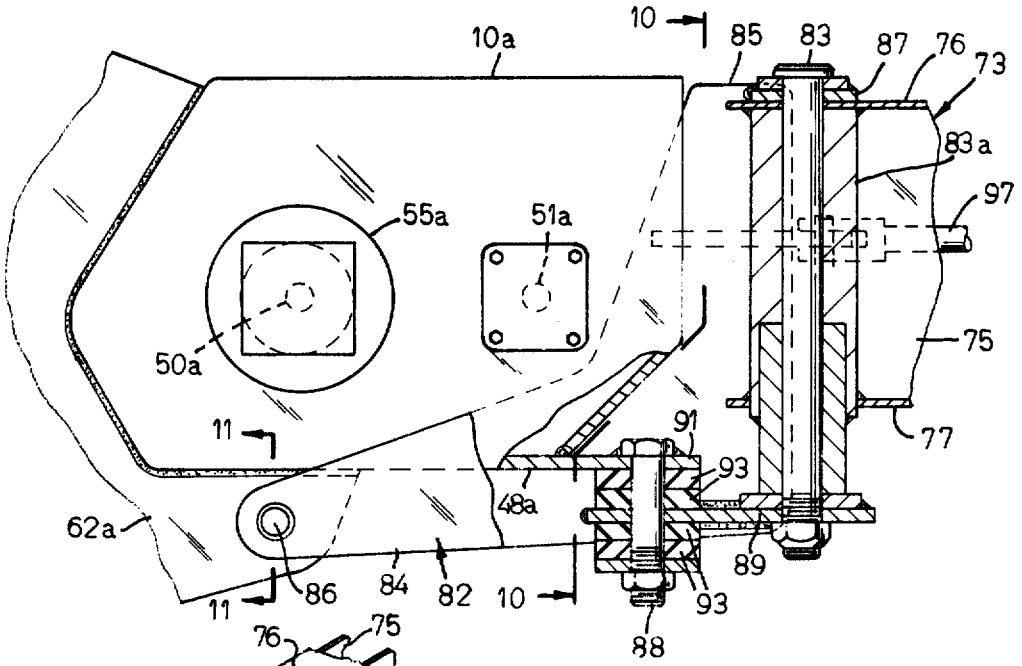
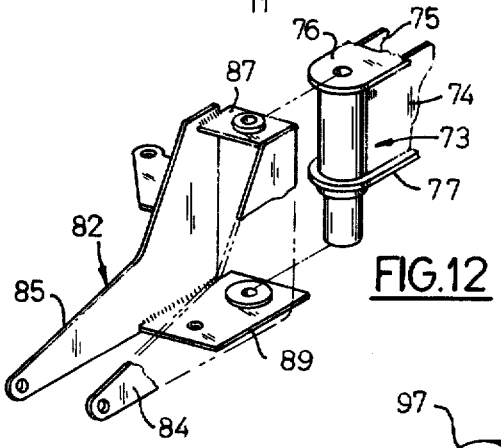
FIG. 12
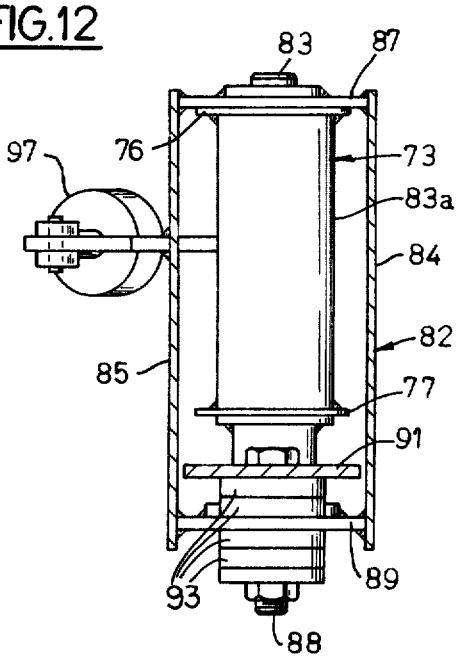
FIG. 10
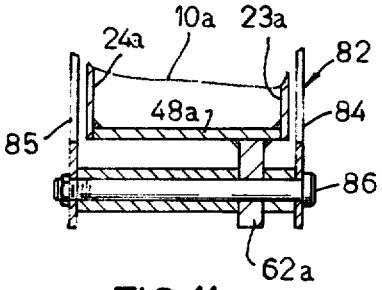
FIG. 11

CABLE LAYING VIBRATORY PLOW ASSEMBLY

BACKGROUND OF THE INVENTION

Many different types of underground cable laying implements have been proposed for simultaneiously cutting a slit in the ground and laying a flexible cable therein and including vibratory means for the plow. While these prior art devices have proved to be successful, they have not always utilized the forces involved to an optimum due to the direction of the vibratory movement of the plow blade. Examples of devices of the prior art type are shown in the U.S. Pat. No. 3,575,006, issued Apr. 13, 1971; U.S. Pat. No. 3,590,588 issued July 6, 1971; or the U.S. Pat. No. 3,363,423 issued Jan. 16, 1968.

SUMMARY OF THE INVENTION

The present invention provides a cable laying vibratory plow which has a plow blade extending downwardly and forwardly in respect to the direction of plow travel and for forming a slit in the ground for the simultaneous insertion of a flexible cable. The plow of the present invention includes a pair of power driven counter-rotating eccentric weights which rotate about horizontal, transverse axes, and are spaced away from one another in a fore and aft direction (in respect to the direction of plow travel); the shaker case which carries the eccentric weights includes elastomeric isolation mounts on the plow frame. The action of these particularly disposed, counter-rotating weights and their axes causes generally vertical shaking forces to be imparted to the plow frame. The plow of the present invention also includes a weight mass located rearwardly of the plow frame and which together with the vibratory action of the eccentric weights and the elastomeric mounting of the shaker case, acts to form an effective pivot point for the plow blade, which point is located rearwardly of the plow frame and tamp wheel. The resulting combination of forces causes the plow frame to swing in a generally arcuate movement about the effective pivot point, thereby providing a particularly efficient cutting action through the soil as the vehicle pulls the plow through the soil. The arrangement is such that the rear mass tends to make the tamp wheel end of the shaker assembly more nearly stationary, thus providing a rearwardly disposed, effective, constant pivot point. The resulting arcuate movement of the plow blade is generally in an upward and forward soil cutting direction, as opposed to purely vertical forces or other forces.

These and other objects and advantages of the present invention will appear hereinafter as this disclosure progresses, reference being had to the accompanying drawings.

BRIEF DESCRIPTION OF THE DRAWINGS

FIG. 9 is an enlarged, fragmentary side elevational view, with parts broken away or in section of the shaker case and pivot connection with the beam as shown in FIG. 7;

FIG. 10 is a transverse, vertical sectional view taken along the line 10—10 in FIG. 9;

FIG. 11 is a fragmentary sectional view taken along the line 11—11 in FIG. 9; and FIG. 12 is a reduced, fragmentary, exploded view of the rear end of the beam means as shown in FIG. 9.

DESCRIPTION OF A PREFERRED EMBODIMENT

Figures 1, 2, 3:
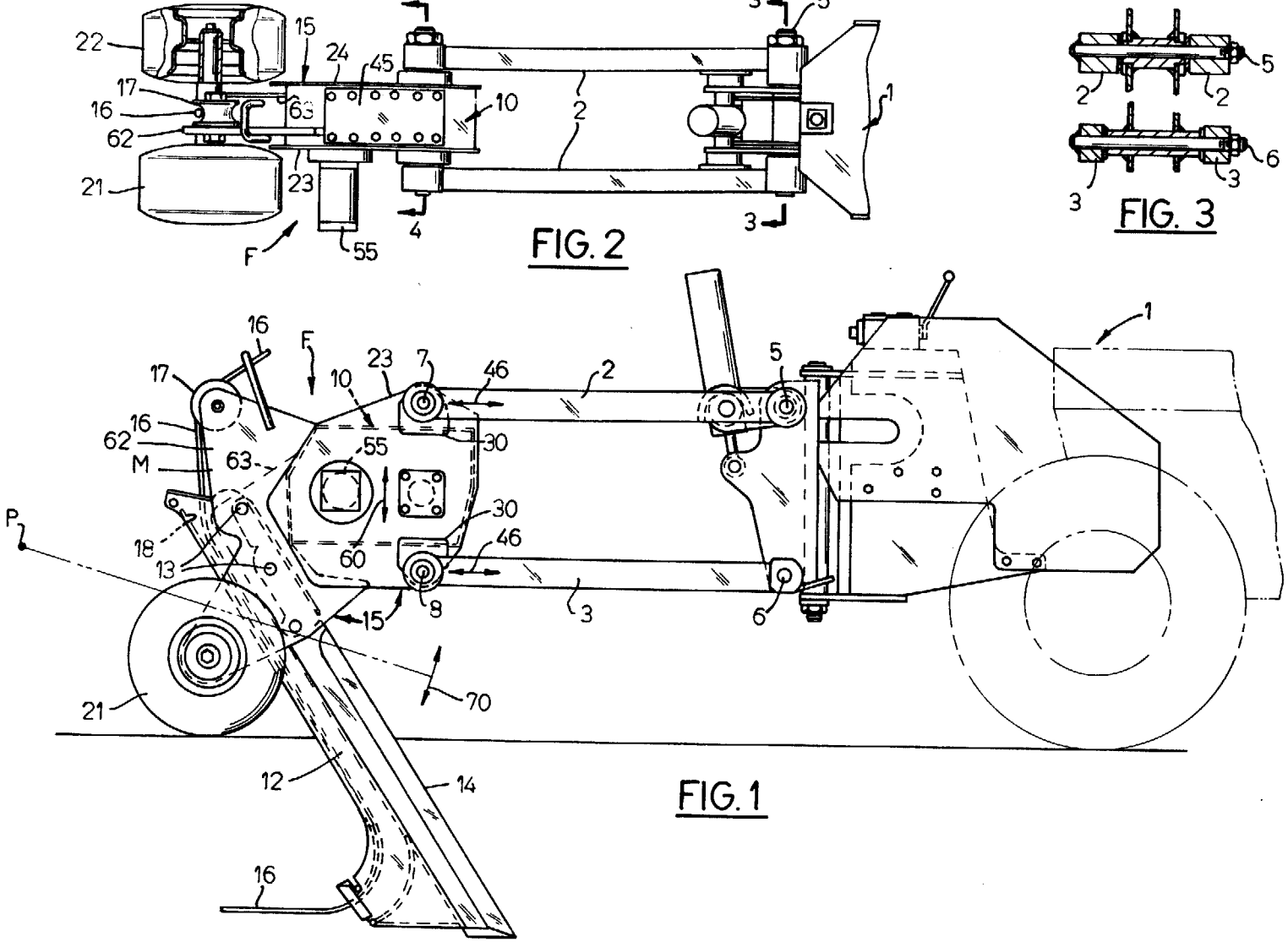
FIG. 1 is a side elevational view of the vibrating plow made in accordance with the present invention.
FIG. 2 is a fragmentary, plan view of the device shown in FIG. 1, certain parts being shown as broken away or in section for the sake of clarity.
FIG. 3 is a vertical transverse sectional view taken generally along the line 3—3 in FIG. 2.

One modification of the invention is shown in FIG. 1 and includes tractive vehicle 1 having beam means in the form of an upper pair of arms 2 and a lower pair of arms 3, pairs of arms 2 and 3 being parallel to one another to form a parallel linkage as shown in FIG. 1. Arms 2 are pivoted about the axis 5 on the vehicle, while arms 3 are pivoted about the axis 6 on the vehicle located directly below axis 5. The rear end of arms 2 and 3 are pivoted, respectively, on shaft 7 and 8 to the shaker case 10 of the plow frame F by elastomeric mounts to be referred to.

The plow frame F also includes a forwardly and downwardly extending frame member 12 having a sharp plow blade 14 located along its front edge. The intermediate portion 15 of the plow frame is rigidly secured by bolt means 13 to the upper end of the member 12 and is also rigidly secured, as by welding for example, to the shaker case 10.

A cable 16 to be laid is trained around an idler pulley 17 and is directed downwardly and forwardly through the passageway 18 in the frame member 12 where it emerges at the lower end in the slit formed by the blade 14 in the known manner. Tamp means in the form of a pair of tamp wheels 21 and 22 are located generally rearwardly of the plow frame and are journalled on the plow frame for supporting it at a constant attitude to the ground over which it traverses.

Frame portion 15 includes two, transversely spaced, vertical side walls 23 and 24 which form the side walls of the shaker case 10, to be described presently in detail.

Figure 4:
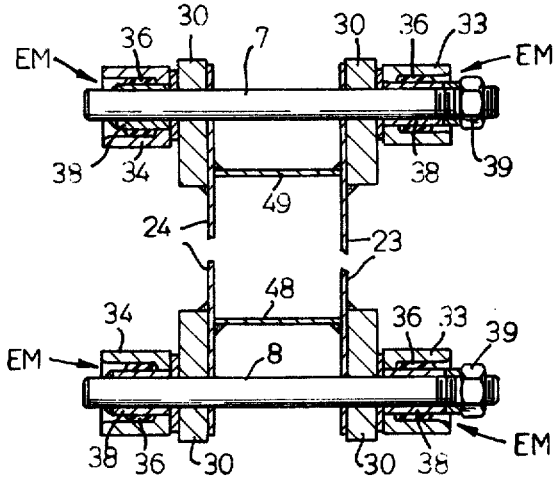
FIG. 4 is a sectional view taken on line 4—4 in FIG. 2, but on an enlarged scale.

FIG. 4 shows the elastomeric isolation mounts EM between the plow beam and the plow frame. More specifically, the shaker case 10 has reinforcing blocks 30 welded to the vertical side walls 23 and 24 to provide a firm mounting for the shafts 7 and 8. Pairs of cup-like sockets 33 and 34 are provided and which contain rubber sleeves 36 in which are mounted sleeve bearings 38 welded to the shafts 7 and 8 at one end thereof, and these shafts form pivot axes for the parallel arms. The other end of shafts 7 and 8 are threaded to receive nuts 39. The arrangement of the elastomeric sleeves 36 is such that they deflect in the generally horizontal direction of the double ended arrows 46 as shown in FIG. 1 and deflection of the elastomeric mounts in this direction contributes to the desired plow blade motion as will appear. Thus, these mounts also isolate the vibrations from the beam means 2, 3, and the vehicle. Rear wall 46, front wall 47, bottom wall 48, and top wall 49 are welded between and to the side walls 23 and 24 so as to form the rigid and closed shaker case 10. A removable access top cover 45 is also provided.

Figure 6:
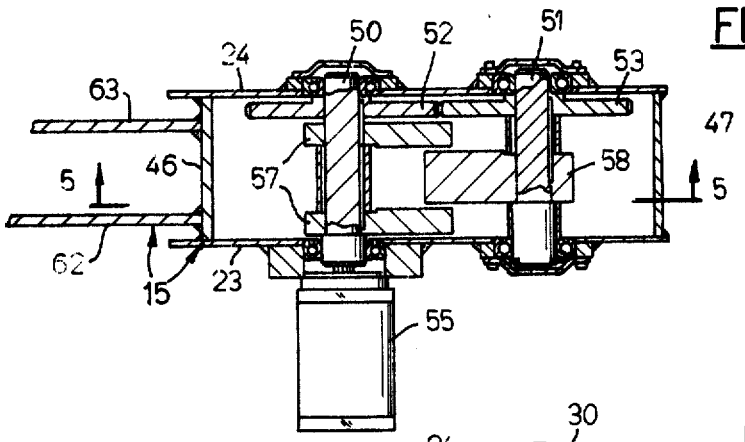
FIG. 6 is a horizontal sectional view taken along line 6—6 in FIG. 5.

A pair of counter-rotating, eccentric weights are journalled within the shaker case as follow. A pair of shafts 50 and 51 are rotatably journalled in the case and have gears 52 and 53, respectively, fixed thereon. Gears 52 and 53 are in constant mesh with one another so that a hydraulic motor 55 which is fixed to and drives a shaft 50, also drives a shaft 51 through the constant mesh gears. Shafts 50 and 51 are suitably mounted on anti-friction bearing assemblies, as shown in FIG. 6. Eccentric weight means 57 are fixed to shaft 50 while eccentric weight means 58 is fixed to shaft 51. Weights 57 and 58 are 180° out-of-phase with one another and their shafts 50 and 51 are spaced in fore and aft direction of plow travel. In other words, the shafts are mounted in a horizontal plane, extend transversely of the plow, and are spaced apart from one another in the direction of plow travel. Thus, the vibratory action imparted by the counter-rotating eccentric weights is generally vertical, and this shaker force is indicated by the double ended arrows 60 in FIGS. 1 and 5.

The front weight 58 is made the same weight as the rear weight 57 to cancel out forces in a front to rear direction.

Also in accordance with the present invention and in order to contribute to the desired arcuate swinging movement of the plow blade, a weight mass M is provided rearwardly of the shaker case and at the rearward end of the plow frame and this mass may take various forms. In the embodiment of the invention as shown in FIGS. 1 and 2, this weight mass is comprised of a particularly thick and heavy steel plate 62 which is welded to the rear wall 46 of the shaker case. Another plate 63 is also welded to the wall 46. The wheels 21 and 22 are suitably journalled on their axle which is mounted to plate 62. This weight mass M tends to make the tamp wheel end of the plow frame more nearly stationary, that is to say, it reduces the amplitude of vibration at the rear end of the assembly and also increases the amplitude at the front end, and, in conjunction with the forces previously described of the eccentric weights and the elastomeric isolation mounts, results in an effective pivot point P which is shown in FIG. 1 and is located rearwardly of the plow frame and tamp wheels 21 and 22. This imaginary pivot point forms the center of the arcuate movement of the plow blade which arcuate movement is indicated by the double curvilinear arrow 70 shown in FIG. 1. This desired movement of the plow blade acts to impact the soil in the optimum, upward and forward direction and as a result efficiently slices through the group with the desired cutting action and minimum horsepower.

Figure 8:
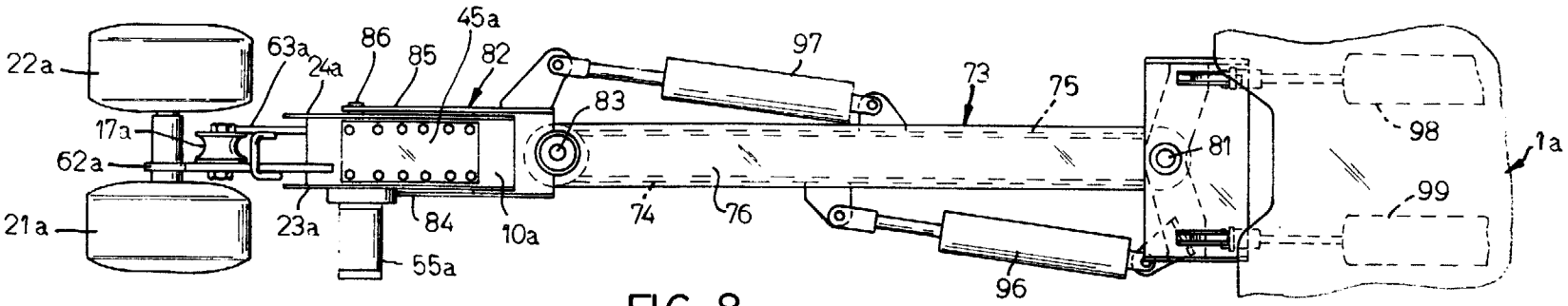
FIG. 8 is a plan view of the plow shown in FIG. 7.
Figure 7:
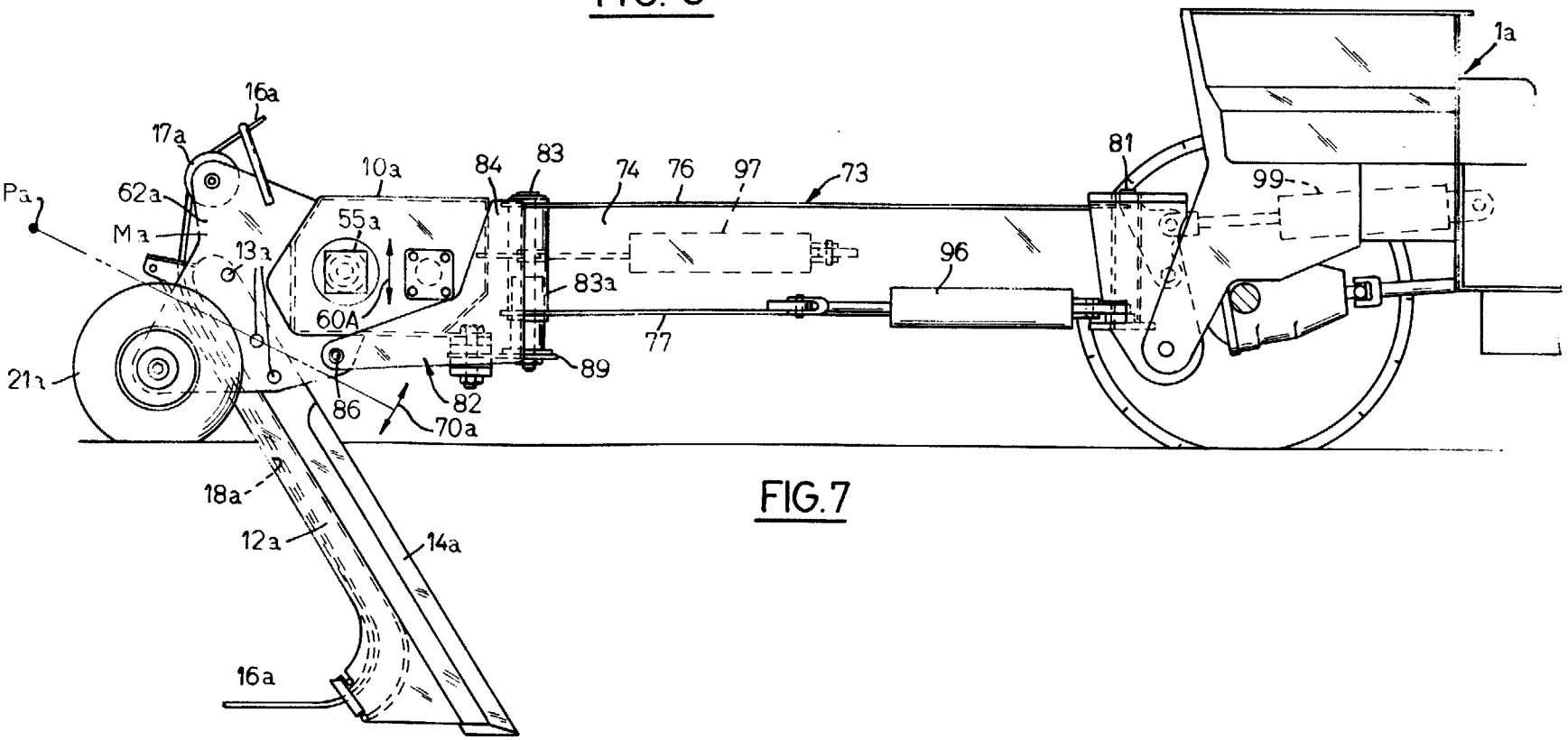
FIG. 7 is a side elevational view of a vibrating plow made in accordance with the present invention showing a modification of that shown in FIG. 1.

Another modification of the invention is shown in FIGS. 7 and 8 wherein a rigid plow beam 73 is used and is fabricated from steel plates in the form of a rectangular box frame member having sides 74, 75, a top 76 and bottom 78. This beam is pivoted about the vertical axis 81 to the vehicle and has a sub-frame 82 pivoted about the vertical shaft 83 to the rear end of the rigid beam 73. Shaft 83 is mounted in a vertical sleeve means **83*a* which is welded to box beam 73. Sub-frame 82 has a pair of vertical sides 84 and 85 between and to which are welded the cross plates 87 and 89 and which in turn receive and support the shaft 83 (FIG. 12) and is connected by a shaft 86 to the heavy mass plate 62*a* which in turn is welded to the shaker case 10*a*, as in the FIG. 1** embodiment.

Figure 5:
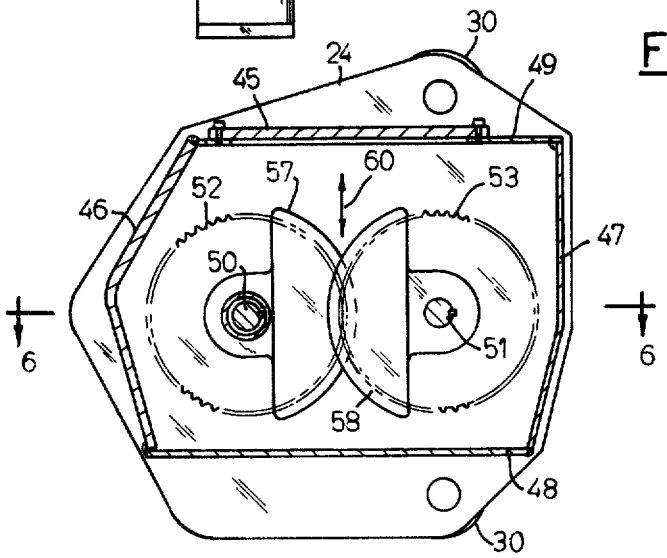
FIG. 5 is a vertical sectional view taken along the line 5—5 in FIG. 6 and through the shaker case.

The shaker case **10*a* utilized in the FIGS. 7 and 8 embodiment is the same as shown in FIGS. 5 and 6 and the vertical force imparted by the rotating weights is the same as previously described, consequently further description of the shaker case and its weights is not believed to be necessary. Furthermore, the plow, plow frame, tamp wheels and weight mass are similar to those shown and described in connection with FIGS. 1 and 2** and the parts are similarly numbered together with a suffix *a*.

The sub-frame 82 is welded to the rearwardly extending plate 89 to form a unitary structure therewith. Frame 82 is mounted by bolt means 88 to a forwardly extending end 91 of bottom member 48 of the shaker case. It will be noted that an elastomeric isolation mount 93 is also provided on bolt means 88 and between the shaker case **10*a*, sub-frame 82, and beam means 73.**

The rigid beam structure shown in FIGS. 7 and 8 is particularly desirable when an offset plowing action is to be accomplished, for example, along a roadside. Suitable double acting hydraulic cylinders 96 and 97 laterally position the plow. Hydraulic cylinders 98, 99 can raise and lower the plow assembly.

In either of the embodiments shown, the combination of forces imparted by the pair of counter-rotating eccentric weight means having their horizontal and transverse axes spaced apart in a fore and aft direction, the forces imparted by the deflection of the elastomeric isolation mounts, and the effect of the weight mass at the rear of the plow assembly all contribute to provide an effective pivot point located rearwardly of the plow assembly and by means of which the plow blade swings in an arcuate movement, namely in an upward and forward movement to efficiently cut through the terrain.

We claim:

1. A vibratory plow assembly including a plow frame, a plow blade extending downwardly and forwardly from said frame and in respect to the direction of travel of said plow assembly and for forming a slit in the ground, ground engaging means for supporting said assembly, a pair of power driven counter rotating eccentric weights on said plow frame, said weights being rotatable about transverse horizontal axes which are spaced apart in the direction of travel of said plow to thereby position one weight rearwardly of the other, and a weight mass on the rear end of said plow frame; beam means for connecting said assembly to a tractive vehicle, first means for pivotably connecting said plow frame to said beam means, and second means for pivotably connecting said beam means to said tractive vehicle, said first means including elastomeric isolation mounts, whereby a pivot point for said plow frame is established rearwardly of said assembly and about which point the plow blade swingably vibrates in an upward and forward stroke.

2. The plow assembly as set forth in claim 1 further characterized in that the forwardly located eccentric weight is about the same weight as the eccentric weight located rearwardly thereof.

3. A vibratory plow assembly for being pulled by a tractive vehicle and for laying cable and including a plow frame, ground engaging means for supporting said assembly for travel over the ground, a plow blade extending downwardly and forwardly from said frame and in respect to the direction of travel of said plow assembly and for forming a slit in the ground, vibratory means including a pair of power driven counter-rotating eccentric weights on said plow frame, said weights being rotatable about their individual transverse horizontal axes, said axes being spaced apart in the direction of travel of said plow to thereby position one weight rearwardly of the other, whereby said weights impart generally vertical vibratory forces to said plow assembly, and a weight mass on the rear end of said plow frame and located rearwardly of said eccentric weights to reduce the amplitude of the vibrations of the eccentric weights at the rear end of the plow frame; beam means for connecting said assembly to said tractive vehicle, first means for pivotably connecting said plow frame to said beam means, and second means for pivotably connecting said beam means to said tractive vehicle, said first means including elastomeric isolation mounts connecting said plow frame to said beam means for absorbing generally horizontal components of vibration, whereby a pivot point for said plow frame is established rearwardly of said assembly and about which point the plow blade swingably vibrates in an upward and forward stroke.

4. The plow assembly as set forth in claim 3 further characterized in that the forwardly located eccentric weight is about the same weight as the eccentric weight located rearwardly thereof.

5. A vibratory plow assembly for being pulled by a tractive vehicle and for laying cable and including a plow frame, a plow blade extending downwardly and forwardly from said frame and in respect to the direction of travel of said plow assembly and for forming a slit in the ground, guiding means for guiding a cable into said slit in the ground formed by said plow blade, said assembly also having ground engaging wheel means, a shaker case secured to said plow frame, a pair of power driven counter-rotating eccentric weights in said shaker case, said weights being rotatable about their individual transverse horizontal axes, said axes being spaced apart in the direction of travel of said plow to thereby position one weight rearwardly of the other, whereby said weights impart generally vertical vibratory forces to said plow assembly, and a weight mass on the rear end of said plow frame and located rearwardly of said shaker case to reduce the amplitude of the vibrations of the counter-rotating weights at the rear end of the plow frame; beam means for connecting said assembly to a tractive vehicle, first means for pivotably connecting said plow frame to said beam means, and second means for pivotably connecting said beam means to said tractive vehicle, said first means including elastomeric isolation mounts connecting said plow frame to said beam means for absorbing generally horizontal components of vibration, whereby a pivot point for said plow frame is established rearwardly of said assembly and about which point the plow blade swingably vibrates in an upward and forward stroke.

6. The plow assembly as set forth in claim 4 further characterized in that the forwardly located eccentric weight is about the same in weight as the eccentric weight located rearwardly thereof.

7. The plow assembly set forth in claim 5 further characterized in that said beam means is a pair of parallel links for permitting said shaker case and plow frame to rise and fall bodily at substantially a constant attitude to the ground, said parallel arms contributing to the isolation of vertical vibrations of the shaker case from said tractive vehicle.

* * * * *